US010415341B2

(12) United States Patent
Farmer et al.

(10) Patent No.: US 10,415,341 B2
(45) Date of Patent: Sep. 17, 2019

(54) DOWNHOLE SYSTEM USING PACKER SETTING JOINT AND METHOD

(71) Applicants: Jack D. Farmer, Houston, TX (US); David B. Ruddock, Pearland, TX (US); Michael J. Naquin, Houston, TX (US); Allan R. McCoy, League City, TX (US)

(72) Inventors: Jack D. Farmer, Houston, TX (US); David B. Ruddock, Pearland, TX (US); Michael J. Naquin, Houston, TX (US); Allan R. McCoy, League City, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 773 days.

(21) Appl. No.: 14/805,542

(22) Filed: Jul. 22, 2015

(65) Prior Publication Data

US 2016/0024859 A1 Jan. 28, 2016

Related U.S. Application Data

(60) Provisional application No. 62/029,800, filed on Jul. 28, 2014.

(51) Int. Cl.

| | |
|---|---|
| ***E21B 17/00*** | (2006.01) |
| ***E21B 33/12*** | (2006.01) |
| ***E21B 41/00*** | (2006.01) |

(52) U.S. Cl.

CPC ..... *E21B 33/12* (2013.01); *E21B 17/00* (2013.01); *E21B 41/00* (2013.01)

(58) Field of Classification Search

CPC ..... E21B 33/122; E21B 17/08; E21B 33/12; E21B 17/00; E21B 41/00

See application file for complete search history.

(56) References Cited

U.S. PATENT DOCUMENTS

| | | | | |
|---|---|---|---|---|
| 2,111,196 | A * | 3/1938 | Texter | F16L 15/001 166/242.6 |
| 2,120,062 | A * | 6/1938 | Blevins | E21B 17/08 285/288.1 |
| 2,130,587 | A * | 9/1938 | Kane | E21B 17/08 219/137 R |

(Continued)

OTHER PUBLICATIONS

Bercegeay, et al. "A One-Trip Gravel Packing System"; Offshore Technology Confernce 1974; SPE 4771; 12 pages.

(Continued)

*Primary Examiner* — William D Hutton, Jr.
*Assistant Examiner* — Steven A MacDonald
(74) *Attorney, Agent, or Firm* — Cantor Colburn LLP

(57) ABSTRACT

A downhole system including tubular casing string and a packer setting joint configured to receive a packer therein. The packer setting joint includes an interior and an exterior, and all interior and exterior surfaces from an uphole to a downhole end of the packer setting joint are machined surfaces. The uphole end of the packer setting joint is connected to the casing string, and the downhole end of the packer setting joint is connected to the casing string. The packer setting joint has a greater burst strength than a burst strength of a casing joint connected to the packer setting joint within the casing string.

21 Claims, 4 Drawing Sheets

(56) References Cited

U.S. PATENT DOCUMENTS 2,365,794 A * 12/1944 Armentrout ..... E21B 47/10 138/90
2,837,165 A * 6/1958 Roberts ..... E21B 43/25 166/114
3,948,575 A * 4/1976 Rosser ..... E21B 17/1078 175/325.2
4,132,270 A * 1/1979 Holland ..... E21B 33/12 166/371
4,416,476 A * 11/1983 Garrett ..... E21B 17/16 285/288.1
4,600,056 A * 7/1986 Burton, Jr. ..... E21B 33/14 166/191
5,059,043 A * 10/1991 Kuhne ..... E21B 17/00 166/243
5,577,560 A * 11/1996 Coronado ..... E21B 17/003 166/106
5,704,425 A 1/1998 Divis et al.
6,311,772 B1 * 11/2001 Myhre ..... E21B 33/124 166/278
6,896,056 B2 5/2005 Mendez et al.
6,966,368 B2 11/2005 Farquhar
8,016,036 B2 9/2011 Kirkwood et al.
9,732,606 B2 * 8/2017 Frosell ..... E21B 47/0905
2007/0084603 A1 4/2007 Livingstone
2008/0066917 A1 3/2008 Lehr et al.
2009/0159298 A1 * 6/2009 Assal ..... E21B 33/124 166/386
2010/0116496 A1 * 5/2010 Allen ..... E21B 33/1208 166/292
2010/0147509 A1 6/2010 Richard et al.
2012/0298380 A1 11/2012 Rogers et al.
2015/0377009 A1 * 12/2015 Frosell ..... E21B 47/0905 166/382

OTHER PUBLICATIONS

Notification of Transmittal of the International Search Report and the Written Opinion of the International Searching Authority; PCT/US2015/036863; Korean Intellectual Property Office; dated Sep. 21, 2015; 14 pages.
Retrievable Seal Bore Packer—Dual Bore; D&L Oil Tools catalog; Feb. 2016; www.dloiltools.com; 1 page.

* cited by examiner

DOWNHOLE SYSTEM USING PACKER SETTING JOINT AND METHOD

CROSS REFERENCE TO RELATED APPLICATIONS

This application claims the benefit of an earlier filing date from U.S. Provisional Application Ser. No. 62/029,800 filed Jul. 28, 2014, the entire disclosure of which is incorporated herein by reference.

BACKGROUND

In the drilling and completion industry, the formation of boreholes for the purpose of production or injection of fluid is common The boreholes are used for exploration or extraction of natural resources such as hydrocarbons, oil, gas, water, and alternatively for CO2 sequestration.

In order to operate to its full envelope rating, a packer typically must be set in cemented (supported) casing. In many wells, getting a good cement job on the casing string is difficult or unpredictable. Operators are requiring equipment ratings in both supported and unsupported casings for added assurance the packer will function within required parameters should they not be able to achieve a good cement job. In instances where the casing is not supported, testing and extensive finite element analysis ("FEA") is required to determine the packer's rating. The FEA and subsequent validation testing is somewhat unpredictable due to inconsistencies in as-rolled casing. This forces safety factors to be applied to compensate for worst case scenarios.

The art would be receptive to alternative devices and methods for predicting packer performance.

BRIEF DESCRIPTION

A downhole system including tubular casing string; and, a packer setting joint configured to receive a packer therein, the packer setting joint having an interior and an exterior, and all interior and exterior surfaces from an uphole to a downhole end of the packer setting joint being machined surfaces, the uphole end of the packer setting joint connected to the casing string, and the downhole end of the packer setting joint connected to the casing string; wherein the packer setting joint has a greater burst strength than a burst strength of a casing joint connected to the packer setting joint within the casing string.

A method of employing a downhole packer, the method includes connecting a packer setting joint to uphole and downhole casing joints within a casing string, the packer setting joint having an entirely machined interior and an entirely machined exterior from an uphole end to a downhole end of the packer setting joint, the packer setting joint having a greater burst strength than the uphole and downhole casing joints; running the casing string with packer setting joint into a borehole; running a tubing having a packer thereon into the casing string; and, setting the packer within the packer setting joint.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
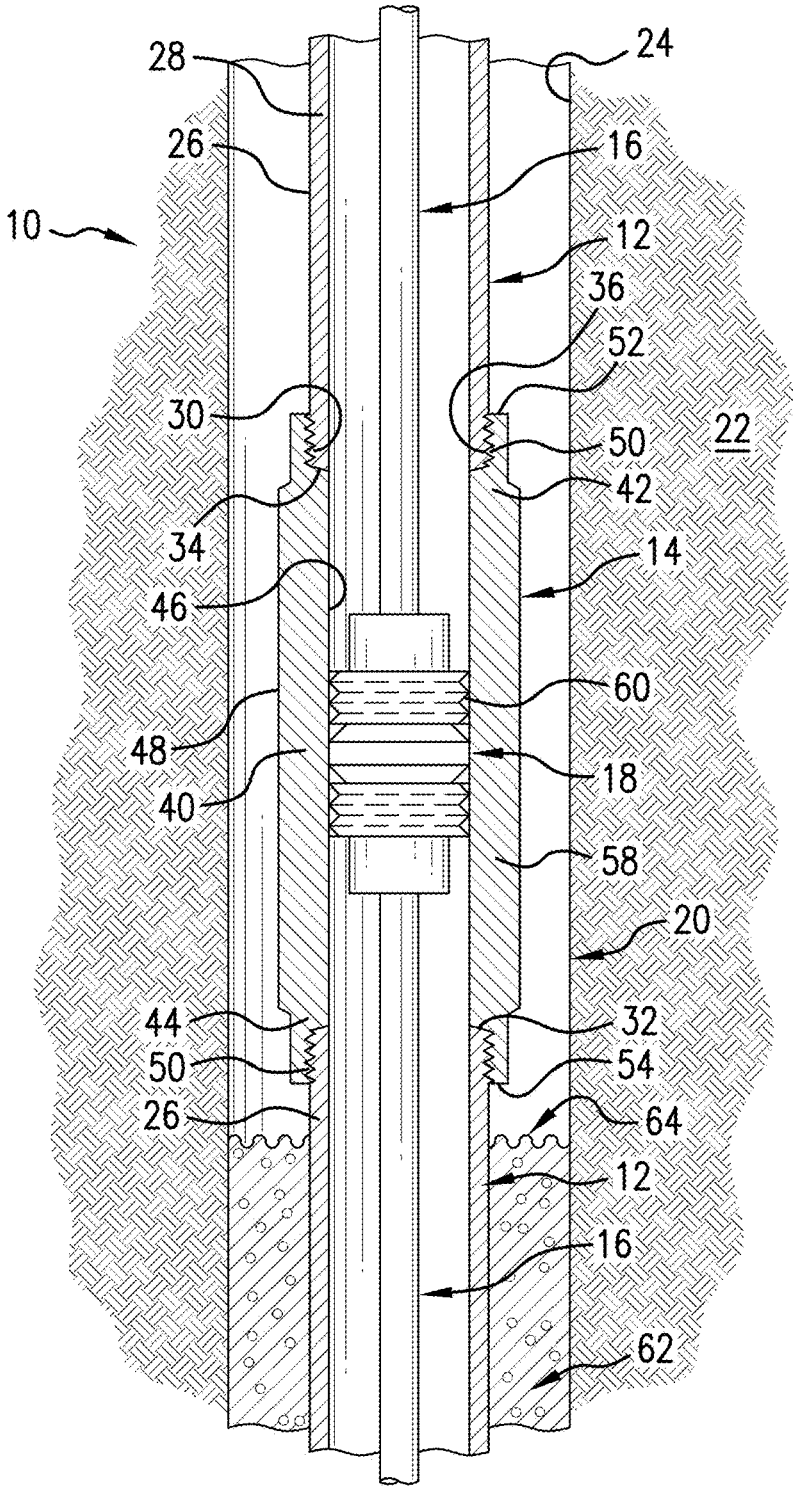
FIG. 1 depicts a cross-sectional view of an embodiment of a downhole system having a casing and an embodiment of a packer setting joint, with a tubing and packer run therein.

An embodiment of a downhole system 10 for predicting packer performance is shown in FIG. 1. The downhole system 10 includes a casing string 12, a packer setting joint 14, and tubing 16 having a packer 18 secured thereto. The packer 18 is illustrated in an expanded condition, however it should be understood that the packer 18 would be run into the casing string 12 and packer setting joint 14 in an unexpanded condition prior to being set (expanded) within the packer setting joint 14. The downhole system 10 is installed within a borehole 20 that extends through a formation 22. The formation 22 itself varies depending on its geographical location and depth. Thus, the formation wall 24 of the borehole 20 is inconsistent by nature. Each of the features of the downhole system 10 will be described in further detail below.

The casing string 12 includes a plurality of tubular casing sections or "joints" 26 which are formed in as-rolled casing/pipe. One method of forming the casing joints 26 with a seamless construction includes heating and drawing a solid billet over a piercing rod to create a hollow shell. The heated billet is molded and rolled until the cylindrical shape is achieved. Another method of forming the casing joint 26 includes rolling a plate of material (metal) into a cylindrical shape and welding the seam. Since either method of forming casing joints 26 uses rolling, the casing joints will be described herein as "rolled" casing joints 26. The American Petroleum Institute ("API") allows for tolerances in the outer diameter ("OD") and inner diameter ("ID") of the casing joint 26. For example, for a casing joint 26 having a nominal OD of 4.5 inches, the OD may be anywhere from 4.478 to 4.545 inches and the ID may be anywhere from 4.036 to 4.154 inches. When an exact thickness of casing wall 28 is not known and the expectation for a good cementing job not guaranteed, the performance of the packer 18 to be set within a casing joint 26 of the casing string 12 would be difficult to predict. Testing and extensive finite element analysis ("FEA") would be required to determine the rating of a packer 18 set within such a rolled casing joint 26. The FEA should also be performed on the particular casing joint 26 that the packer 18 is intended to be set for accurately determining the rating of the packer 18 since each casing joint 26 may have a different wall thickness.

Figure 2:
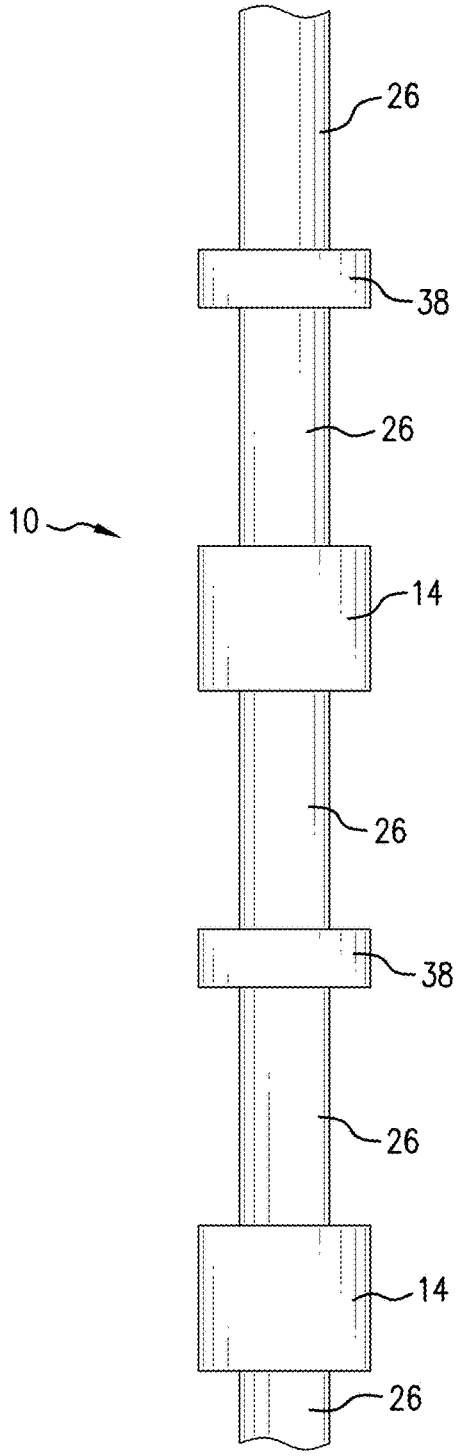
FIG. 2 depicts a side view of the downhole system of FIG. 1 having a plurality of casing joints and packer setting joints.

The casing joints 26 include a connection feature 30 on an uphole end 32 and downhole end 34 of the casing joint 26, such as male threads 36 as shown. While only two casing joints 26 are shown in FIG. 1, it should be understood that many casing joints 26 are connectable together for running into the borehole 20. A typical length of casing joint 26 may be 40 feet, however other lengths are within the scope of these embodiments. In some embodiments of the downhole system 10, hundreds to thousands of feet of casing string 12 may be provided within a single borehole 20. Two adjacent casing joints 26 may be attached to each other using a casing coupling 38, such as depicted in FIG. 2. For example, when the casing joints 26 each have an uphole end 32 and downhole end 34 with male threads 36, the casing coupling 38 may include cooperating female threads (not shown) therein for receiving both ends of the adjacent casing sections 26. In lieu of the casing coupling 38, the casing joint 26 may have, at either the uphole end 32 or downhole end 34, a box thread (not shown) for interconnecting adjacent casing joints 26.

Distinct from the casing joints 26, the packer setting joint 14 is a heavy wall machined fixture. The manufacturing process for producing the machined packer setting joint 14 may include cutting a piece of material (metal) into the desired final shape and size, such as by, but not limited to, a controlled material-removal process using a computer numerical control ("CNC") machine in which computers are used to control the movement and operation of the CNC tools. Other accurate methods not including computer controlled machines may be used to machine the fixture may also be incorporated. The ID and OD of the packer setting joint 14 can be measured immediately and corrected as needed during the machining process until it has the precise measurements desired. It should be understood that manufacturing every casing joint 26 as a machined component would be prohibitively, and unnecessarily, time consuming and expensive. Thus, within the downhole system 10, the packer setting joint 14 is machined while the casing joints 26 are as-rolled. The packer setting joint 14 includes a packer setting section 40 having an uphole end 42 and a downhole end 44. The packer setting section 40 has a machined interior surface 46 and a machined exterior surface 48 from the uphole end 42 to the downhole end 44. It should be understood that the machined interior surface 46 and machined exterior surface 48 may be inclusive of honing. That is, honing may be a form of machining used for the machined interior surface 46. That is, the entire interior surface 46 and the entire exterior surface 48 of the packer setting section 40 is machined. Flanking the packer setting section 40 is a connection feature 50 at an uphole end 52 and a downhole end 54 of the packer setting joint 14. As illustrated, the connection feature 50 includes female threads 56 sized to engage with male threads 36 of the casing joints 26, however the packer setting joint 14 may have any connection feature 50 compatible with the connection feature 30 of the casing joints 26. Since threads are also a machinable feature, the connection feature 50 of the packer setting joint 14 is also machined. Thus, the entire packer setting joint 14 is a machined item, with every exposed surface of the packer setting joint 14 being machined. The packer setting joint 14 and the casing string 12, and casing joints 26 adjacently connected thereto, share the same longitudinal axis and allow fluid flow and tools to pass through an interior of the packer setting joint 14 and casing joints 26 (until the casing string 12 is blocked, such as by packer 18 or other tool or obstruction). An ID of the machined packer setting section 14 may be substantially equal to the ID of the casing string 12, or substantially equal to the ID of the particular nominal pipe size ("NPS") of the casing joints 26, such that the interior surface 46 of the packer setting section 14 and the interior of the casing string 12 are at least substantially flush with each other, and as seamless as possible. The OD, however of the machined packer setting section 40 is larger than the OD of the casing joints 26. The OD of the packer setting section 40 may be substantially the same as the OD of the coupling 38 (FIG. 2), but may be alternatively sized. The thickness of the wall 58 of the packer setting joint 14 is selected to allow a particular packer 18 to be set therein without the requirement of added support from cement 62. That is, the burst strength rating (minimum burst pressure) of the packer setting joint 14, which is proportional to wall thickness, is greater than that of the casing joints 26 of the casing string 12. The machined dimensions of the packer setting joint 14 remove the guesswork of setting a packer 18 within as-rolled casing 26 having questionable cementing support. Also, the packer setting joint 14 will not have variations in wall thickness, ovality, or straightness, unlike the as-rolled casing joints 26.

In some embodiments, lengths of the packer setting joint 14 may range from 20 feet to 30 feet long, although the packer setting joint 14 may conceivably be made to any length. When the casing joints 26 of the casing string 12 are approximately 40 feet in length, one method of distinguishing the packer setting joint 14 from the casing joints 26 would be by their differences in length and wall thickness. The packer setting joint 14 is connected within the casing string 12 and run as part of the casing string 12 and positioned within the borehole 20 at the desired packer setting depth. Multiple packer setting joints 14 can be run in the same borehole 20 to provide alternate depth(s) for the packer(s) 18 to be installed in. For example, FIG. 2 shows the downhole system 10 having a plurality of packer setting joints 14. This may be done in the instance where multiple zones of interest exist, multiple packers 18 are installed, or as a means of contingency.

The packer setting joint 14 has substantially the same ID as the casing string 12 and the maximum OD may be the equivalent of the casing coupling 38 or box thread OD, however in some applications the packer setting joint 14 may be made to have a larger OD than the casing coupling 38 to achieve greater performance, depending on the particular packer 18 intended to be set therein. The thicker wall 58 of the packer setting joint 14 in the packer setting section 40 will enable it to offset the forces generated by the rubber pressure from the packer 18 and slips 60 from packer setting operations and differential boost loads. Acting much like a laboratory test fixture, the packer setting joint 14 could conceivably maintain adequate wall thickness to allow the packer 18 to operate at its full pressure rating without any support from cement 62. Overall performance would be generally limited to available wall thickness. That is, the thickness of the wall 58 of the packer setting joint 14 would have to be smaller than the distance between the formation wall 24 and the ID of the packer setting joint 14. Should the packer setting joint 14 happen to be cemented within the borehole 20 (with the top 64 of the cement 62 extending uphole of the uphole end 52 of the packer setting joint 14), the packer 18 will still, of course, be able to operate at its full pressure rating.

Figure 3:
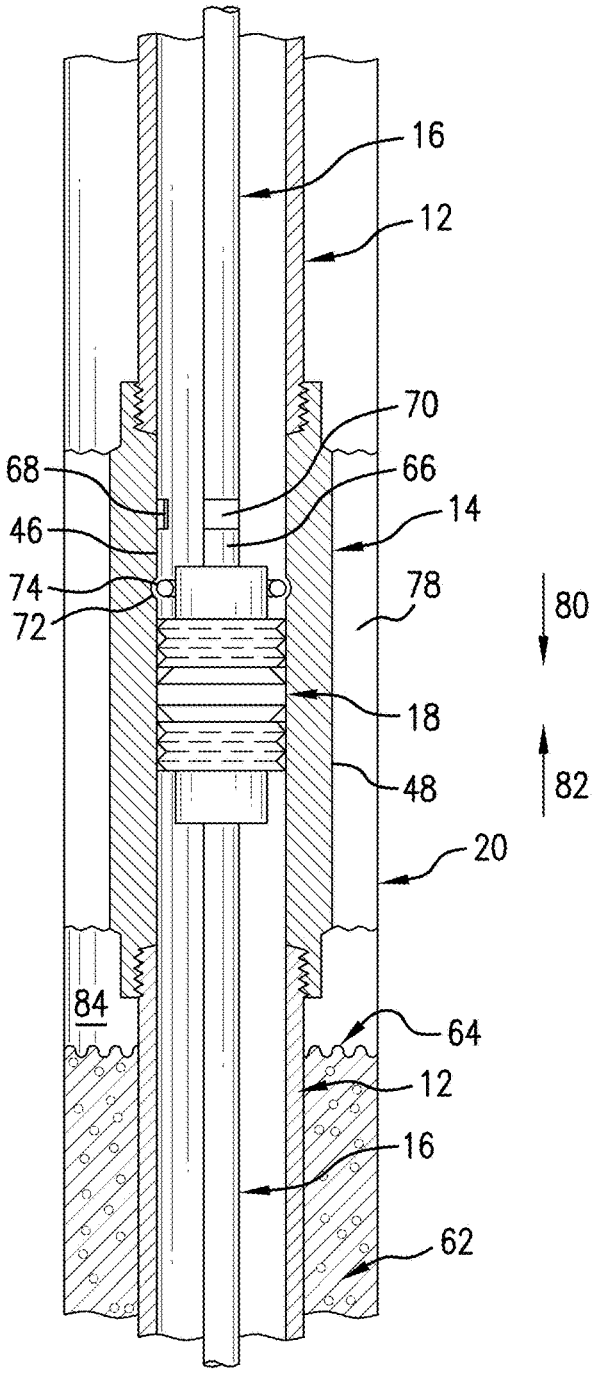
FIG. 3 depicts a cross-sectional view of the downhole system of FIG. 1 with an embodiment of location features and an embodiment of a swellable packer; and, FIG. 4 depicts a side view of an embodiment of the packer setting joint having a groove.

Turning now to FIG. 3, some embodiments of locating features for locating the packer setting joint 14 within the borehole 20 are illustrated. The distinctive length and wall thickness of the packer setting joint 14 would make it easily identified by a collar locator 66 when setting a packer 18 on electric line, making wireline correlations quicker and more accurate. A sensing system in the collar locator 66 is typically used to detect an increased mass of the casing coupling 38 as the locator 66 is moved through the casing string 12 and the coupling 38, however the downhole system 10 described herein employs the collar locator 66 to detect the increased mass of the packer setting joint 14, which the locator 66 may distinguish from the coupling 38 by at least differences in length. That is, even if the coupling 38 and packer setting joint 14 have a same wall thickness, the packer setting joint 14 has a greater length than the coupling 38 and is therefore distinguishable therefrom. An electric output signal may be generated in response to detection of the packer setting joint 14 and used for setting the packer 18 at the appropriate location within the packer setting joint 14. Further details regarding an embodiment of a casing collar locator system are described in U.S. Pat. No. 6,896,056, herein incorporated by reference in its entirety.

In another embodiment, the packer setting joint 14 may be flagged using tags 68, such as, but not limited to, low level radioactive ("RA") tags, which are distinct from the packer setting joint 14 and disposed thereon or therein. The RA tags 68 would be locatable by a locating tool 70, such as a wireline logging tools, via tubing 16 to help position the packer 18 on depth. Further details regarding the use of tags for downhole location detection are described in U.S. Pat. No. 8,016,036, herein incorporated by reference in its entirety.

In yet another embodiment, one or more locator grooves 72 may be placed on (machined into) the interior surface 46 of the packer setting joint 14 to correspond with a locator system 74 installed near the packer 18. In an embodiment, the locator system 74 may include biased extensions that are biased radially outwardly but compressed inwardly when traveling through the casing joints 26 and packer setting joint 14 until the locator groove 72 is reached which allows the biased extensions to extend radially outward into the groove 72, indicating that the packer 18 is at a location within the packer setting joint 14 suitable for setting. The locator groove 72 and locator system 74 cooperate to act as an indicator to aid in getting the packer 18 positioned correctly on depth.

While all of the location features are depicted within the downhole system 10, the downhole system 10 may alternatively include only one or a only a subset of the above-described location features. Also, even if the downhole system 10 included all of the above-described features, any of the location features may still be used alone or in combination for assisting an operator in locating the packer setting joint 14 within the borehole 20 and subsequently setting the packer 18 therein.

Figure 4:
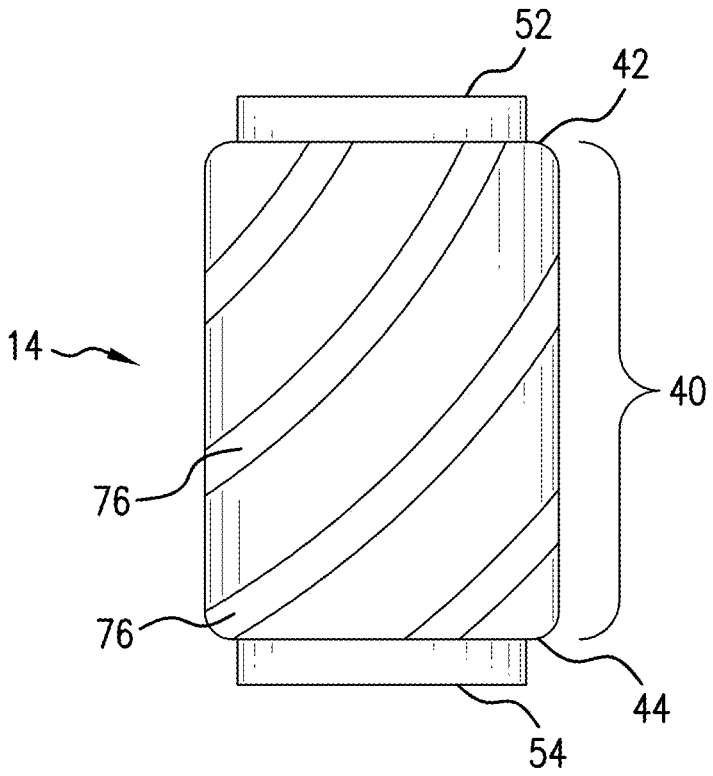

The outer periphery of the packer setting joint 14 may have a circular cross-section from the uphole end 42 to the downhole end 44 of the packer setting section 40. However, in an alternative embodiment, as shown in FIG. 4, the packer setting joint 14 may include a groove or grooves 76, such as a helical or other uphole to downhole extending groove, to facilitate cement bonding between the packer setting joint 14 and the formation wall 24 or fluid bypass through the annulus between the packer setting joint 14 and the formation wall 24. The groove 76 is machined in the packer setting joint 14 such that the packer setting performance can be rated for the particular design of the packer setting joint 14.

A reactive core element, such as an oil or water based swell packer 78, could be a part of the packer setting joint 14, disposed on the exterior surface 48 of the packer setting joint 14, to both create an annular seal between the packer setting joint 14 and the formation wall 24, and assist in supporting the wall 24 surrounding the packer setting joint 14. The swell packer 78 is a self-energizing, reactive element, swelling elastomer that is swellable over time in the presence of downhole fluids, e.g. oil and/or water, to swell to the borehole ID and form a seal. The swell packer 78 is illustrated in FIG. 3 in a swelled condition, however it should be understood that the swell packer 78 would have an OD less than that of the borehole ID while the casing string 12 and packer setting joint 14 is run into the borehole 20. Also, the swell packer 78 may swell in the presence of the liquid cement 62 (which contains water).

The casing string 12 and packer setting joint 14 are first run through the borehole 20 and cemented therein with the cement 62 using a cementing procedure. Cement 62 flows in a downhole direction 80 through the casing string 12 and packer setting joint 14 and then, at the downholemost end of the casing string 12 (not shown), the cement flows in an uphole direction 82 in the annulus 84 between the casing joints 26 and formation wall 24. The tubing 16 and packer 18 may subsequently be run through the casing string 12. As shown in FIGS. 1 and 3, the cement 62 may not extend far enough uphole to reach a location where the packer 18 is to be set. Even if the cement 62 extends through the annulus 84 where the packer 18 is to be set, the nature of the formation 22 may not allow a particularly reliable cementing job. Moreover, the casing joints 26, even when within API min-max casing ID tolerances, are too variable to easily predict packer setting performance within the casing joints 26 in the absence of a proper cementing job. Due to the unpredictable nature of the casing joints 26 and in the area of where a packer 18 is to be set, the use of the packer setting joint 14 improves the ease of predicting a packer performance rating within the packer setting joint 14. This will allow the operator to maintain predictable packer performance ratings when cement 62 is not present to support the casing 12.

As the packer setting joint 14 is run as part of the casing string 12 to set the packer 18 therein, the packer rating can easily be predicted due to the known machined ID and OD of the packer setting joint 14. Installing the packer 18 in a machined (controlled) ID eliminates having to contend with API min-max casing ID tolerances, which can affect performance ratings of the packer 18.

While the invention has been described with reference to an embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A downhole system comprising:

tubular casing string including a plurality of casing joints;

tubing run through at least a portion of the casing string;

a packer disposed on the tubing; and a packer setting joint configured to receive the packer therein, the packer aligned with the packer setting joint, the packer setting joint having an interior and an exterior, and all interior and exterior surfaces from an uphole to a downhole end of the packer setting joint being machined surfaces, the uphole end of the packer setting joint connected to the casing string, and the downhole end of the packer setting joint connected to the casing string;

wherein the packer setting joint has a greater burst strength than a burst strength of the casing joints connected to the packer setting joint within the casing string, and a thickness of a wall of a packer setting section within the packer setting joint is greater than a thickness of a wall of the casing joints connected to the packer setting joint.

2. The downhole system of claim 1, further comprising a casing coupling interconnecting adjacent casing joints within the casing string, wherein an outer diameter of the packer setting section of the packer setting joint is substantially equal to an outer diameter of the casing coupling.

3. The downhole system of claim 1, wherein the casing joints within the casing string are rolled pipe.

4. The downhole system of claim 1, further comprising a plurality of packer setting joints, the packer setting joints dispersed along the downhole system at locations of intended packer settings.

5. The downhole system of claim 1, further comprising a collar locator run with the tubing, the collar locator configured to identify a location of the packer setting joint for setting the packer.

6. The downhole system of claim 5 wherein the collar locator senses a dimension of the packer setting joint for identification of the packer setting joint.

7. The downhole system of claim 1, wherein the packer setting joint includes a tag distinct from the packer setting joint and identifiable by a position locating tool operable with the packer, the position locating tool configured to identify a location of the packer setting joint via the tag for setting the packer.

8. The downhole system of claim 1, wherein the packer setting joint includes at least one locator groove on the interior of the packer setting section, the at least one locator groove identifiable by a locator system associated with the tubing and packer, the locator system having a feature seatable within the groove.

9. The downhole system of claim 1, wherein an exterior of the packer setting section of the packer setting joint has a constant outer diameter from an uphole end to a downhole end of the packer setting section extending between connection features of the packer setting joint.

10. The downhole system of claim 1, wherein the exterior of the packer setting joint has a grooved surface from an uphole end to a downhole end of the packer setting section extending between connection features of the packer setting joint, the grooved surface configured to assist at least one of cement bonding and fluid bypass.

11. The downhole system of claim 1, wherein the interior of the packer setting joint is substantially flush with an interior of the casing string.

12. The downhole system of claim 1, further comprising a swellable packer disposed on the exterior of the packer setting joint, the swellable packer including an elastomer swellable in response to at least one downhole fluid.

13. The downhole system of claim 1, further comprising a casing coupling interconnecting adjacent casing joints within the casing string, wherein a length of the packer setting joint is greater than a length of the casing coupling.

14. The downhole system of claim 13, wherein an outer diameter of the packer setting section of the packer setting joint is substantially equal to an outer diameter of the casing coupling.

15. A method of employing the packer within the downhole system of claim 1, the method comprising:

connecting the packer setting joint to uphole and downhole casing joints within the casing string;

running the casing string with packer setting joint into a borehole;

running the tubing having the packer thereon into the casing string; and, setting the packer within the packer setting joint.

16. The method of claim 15, further comprising locating the packer setting joint using a collar locator prior to setting the packer, the collar locator sensing a dimension of the packer setting joint.

17. The method of claim 15, further comprising locating the packer setting joint by identifying an identifiable tag on the packer setting joint prior to setting the packer.

18. The method of claim 15, further comprising cementing at least a portion of the casing string within the borehole, wherein cement from the cementing does not reach the packer setting joint.

19. The method of claim 15, wherein connecting a packer setting joint to uphole and downhole casing joints includes using casing joints having a rolled construction.

20. The method of claim 15, further comprising predicting performance rating of the packer based on dimensions of the packer setting joint and assuming the packer setting joint will not be cemented within the borehole.

21. The method of claim 15, wherein connecting the packer setting joint to uphole and downhole casing joints within the casing string includes using a swellable elastomer disposed on the exterior of the packer setting joint.

* * * * *